US005588512A

United States Patent [19]

Lin

[11] Patent Number: 5,588,512

[45] Date of Patent: Dec. 31, 1996

[54] INTERNAL FRAME FOR A WHEELED SUITCASE

[76] Inventor: Jerhong Lin, Suite 3, 9th Fl, #294, Tun Hwa S. Rd Section 1, Taipei, Taiwan

[21] Appl. No.: 371,401

[22] Filed: Jan. 11, 1995

[51] Int. Cl.[6] ..... A45C 5/14; A45C 13/04; A45C 13/26

[52] U.S. Cl. ..... 190/115; 190/18 A; 190/122; 190/127; 16/115; 280/37

[58] Field of Search ..... 190/24, 18 A, 190/127, 122, 115, 123, 124, 39; 280/37, 655, 655.1; 16/115

[56] References Cited

U.S. PATENT DOCUMENTS

| | | | |
|---|---|---|---|
| 627,374 | 6/1899 | Wood | 190/122 X |
| 1,019,547 | 3/1912 | Spiro | 190/127 |
| 1,572,868 | 2/1926 | Axelman et al. | 190/127 X |
| 2,755,896 | 7/1956 | Breglia | 190/127 X |
| 3,592,314 | 7/1971 | Jacobson | 190/122 X |
| 4,418,804 | 12/1983 | Bradley et al. | 190/127 X |
| 4,433,760 | 2/1984 | Pelavin | 190/127 X |
| 5,181,590 | 1/1993 | Carpenter et al. | 190/127 X |
| 5,350,046 | 9/1994 | Falloon et al. | 190/115 |

FOREIGN PATENT DOCUMENTS

| | | | |
|---|---|---|---|
| 934545 | 10/1955 | Germany | 190/122 |

*Primary Examiner*—Sue A. Weaver
*Attorney, Agent, or Firm*—The Kline Law Firm

[57] ABSTRACT

An internal frame for supporting a wheeled suitcase comprises a base, a U-shaped frame mounted on top of the base and a central frame comprising a horizontal U-shaped member having two legs on its rear end and two vertical elongated supporting members. The top ends of the two supporting members are connected to the rear ends of the two legs of the U-shaped member. The upper end of the central frame is mounted to the central part of the top panel of the U-shaped frame and the lower end of the central frame is mounted to the bottom panel of the base so that the structure of the internal frame is greatly strengthened by the central frame.

18 Claims, 5 Drawing Sheets

INTERNAL FRAME FOR A WHEELED SUITCASE

BACKGROUND OF THE INVENTION

1. Field of the Invention

This invention relates to an internal frame of a wheeled suitcase and more particularly, to an internal frame comprising a base, a U-shaped frame mounted on top of the base, and a central frame mounted between the U-shaped frame and the base for strengthening the structure of the wheeled suitcase.

2. Description of the Prior Art

Wheeled suitcases popular for traveling because they can easily be pulled rather than carried. In order to reduce the overall weight of a suitcase, most wheeled suitcases use a light-weight internal frame with a layer of flexible material covered on its outside. In such design the internal frame becomes the most important component in supporting the structure of a wheeled suitcase.

One internal frame design is disclosed in U.S. Pat. No. 5,295,565 by Latshaw entitled "Wheeled Luggage". It discloses an internal frame which comprises upper and lower cast skeletal frame members supported by two vertical tubular members in between. The structure of this internal frame is quite simple but it may cause a stress problem over its frame contacting parts. A loaded wheeled suitcase may place heavy stress over the four contacting parts between the two tubular members and the upper and lower frames. In order to make the internal frame strong enough to support the wheeled suitcase the four contacting parts must be made very strong or it may collapse under heavy pressures when traveling. Besides, periodic vibration and/or shock forces exerted over the four contacting parts may also weaken their connections and thus make the internal frame unreliable.

Another internal frame commonly seen in the market is shown in FIG. 1. The internal frame 10 comprises a base 11, a U-shaped frame 12 mounted on top of the base 11, and a central frame 13 mounted between the base 11 and the U-shaped frame 12 for strengthening the structure of the internal frame 10. The central frame 13 is a rigid plastic board for supporting the stuff loaded inside the suitcase when the suitcase is tilted and pulled toward its rear side. There are several problems associated with this internal frame structure. First, the central frame 13 is very bulky and thus may increase the weight of the suitcase. Second, the center and front parts of the base 11 are not supported by the central frame 13 and thus may be bent downward when heavy stuff is loaded in the suitcase. Third, this structure can not take any piggyback suitcase on its upper front end because there is no supporting structure there for taking such suitcase.

SUMMARY OF THE INVENTION

It is therefore the goal of the present invention, by overcoming the limits of the prior art, to devise a new internal frame for supporting a wheeled suitcase to achieve the follow objects:

1. To provide better support over the upper and lower ends of the suitcase without causing stress problem in its supporting structure.

2. To provide piggyback suitcase loading capability on the upper front end of the internal frame.

3. To provide better support over the center and front parts of the base of the internal frame.

Briefly, in a preferred embodiment, the present invention includes a substantially rectangular internal frame for supporting a wheeled suitcase comprising:

(1) a base having a bottom panel, a left panel and a right panel, the lower ends of the left and right panels vertically connected to the left and right ends of the bottom panel separately;

(2) a U-shaped frame mounted on top of the base comprising a top panel and two side panels, the upper ends of the two side panels vertically connected to the left and right ends of the top panel, the lower ends of the two side panels mounted to the left and right panels of the base separately; and (3) a central frame comprising:

(a) a horizontal U-shaped member having two legs on its rear end, and (b) two vertical elongated supporting members, the top ends of the two supporting members connected to the rear ends of the two legs of the U-shaped member;

wherein the U-shaped member of the central frame is mounted to the approximately central part of the top panel of the U-shaped frame and the lower end of the central frame is mounted to the bottom panel of the base whereby the structure of the internal frame is greatly strengthened by the central frame. The rear end of each of the two legs of the U-shaped member comprises an integral L-shaped angle having a lower end facing downward direction wherein the top ends of the two supporting members are connected to the lower ends of the two legs of the U-shaped member. The lower end of each of the two supporting members comprises an L-shaped integral angle having a bottom part facing the front end of the internal frame and the bottom part of the L-shaped integral angle is transversely mounted to the lower end of the bottom panel in order to support the bottom panel when the wheeled luggage is tilted and pulled toward the rearward direction.

It is an advantage of the present invention that its upper end is better supported by both the top panel of the U-shaped frame and the U-shaped member of the central frame when comparing the internal frame shown in U.S. Pat. No. 5,295,565. Besides, the integral L-shaped angles of the U-shaped member on top of the central frame and the two L-shaped integral angles over the lower end of the central frame can more reliably stand heavy stress so that the central frame can provide better structural support to the internal frame without causing the stress problem mentioned above.

It is another advantage of the present invention that the front end of the U-shaped member on top of the central frame can be used to support piggyback suitcase without causing any structural problem.

It is still another advantage of the present invention that the center and front parts of the base of the internal frame are supported by the two L-shaped integral angles on the lower end of the central frame when the wheeled suitcase is tilted and pulled toward the rearward direction.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
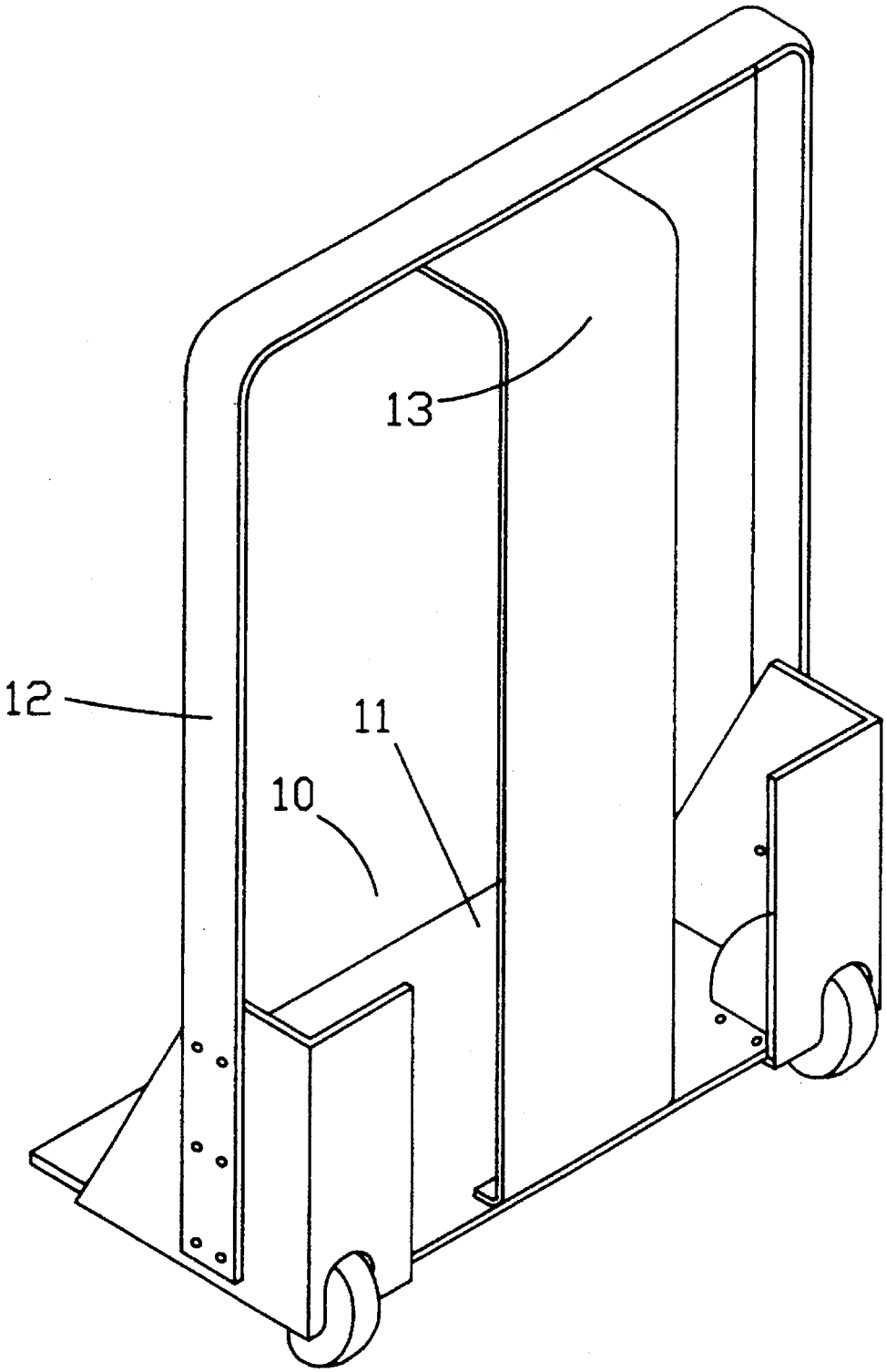
FIG. 1 (PRIOR ART)
FIG. 1 is a perspective view of a prior art which is an internal frame of a wheeled suitcase.
Figure 2:
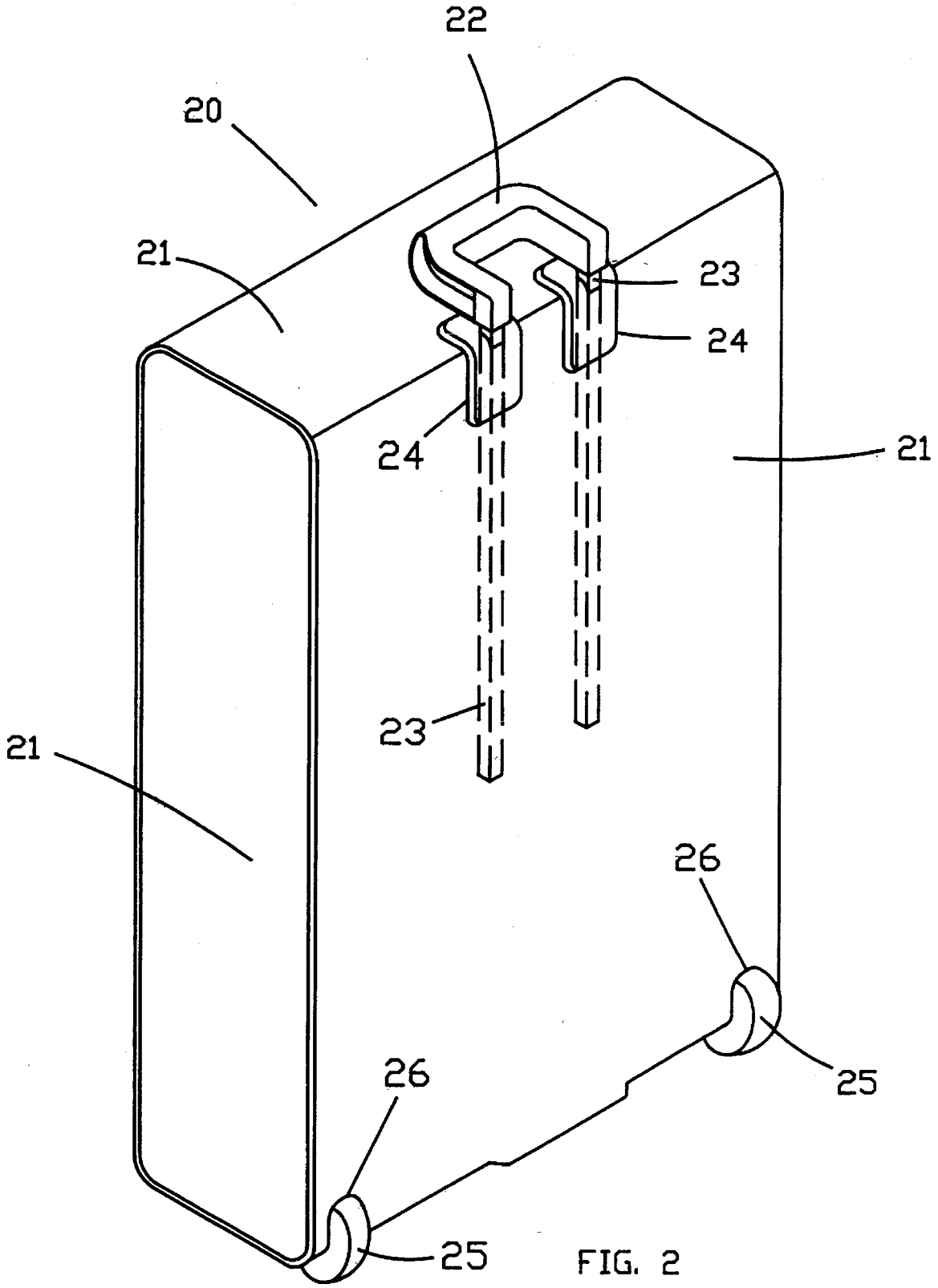
FIG. 2 is a perspective view of a wheeled suitcase according to the present invention.

Please to FIG. 2. FIG. 2 is a perspective view of a wheeled suitcase 20 according to the present invention. The suitcase 20 comprises a flexible cover 21 on its outside, a Dull handle 22 with two legs 23 on its lower end, two leg engaging means 24 on the rear upper side of the suitcase 20 for engaging the two legs 23 of the pull handle 22 separately, two wheels 25, and two recesses 26 on the rear lower end of the suitcase 20 for installing the wheels 25. The two legs 23 of the pull handle 22 retractably engage the two leg engaging means 24 of the suitcase 20. The suitcase 20 further minimizes an opening (not shown) on its front end for accessing the internal space of the suitcase 20. The suitcase 20 can be pulled for traveling by pulling the pull handle 22 up first and then tilted toward the rearward direction.

Figure 3:
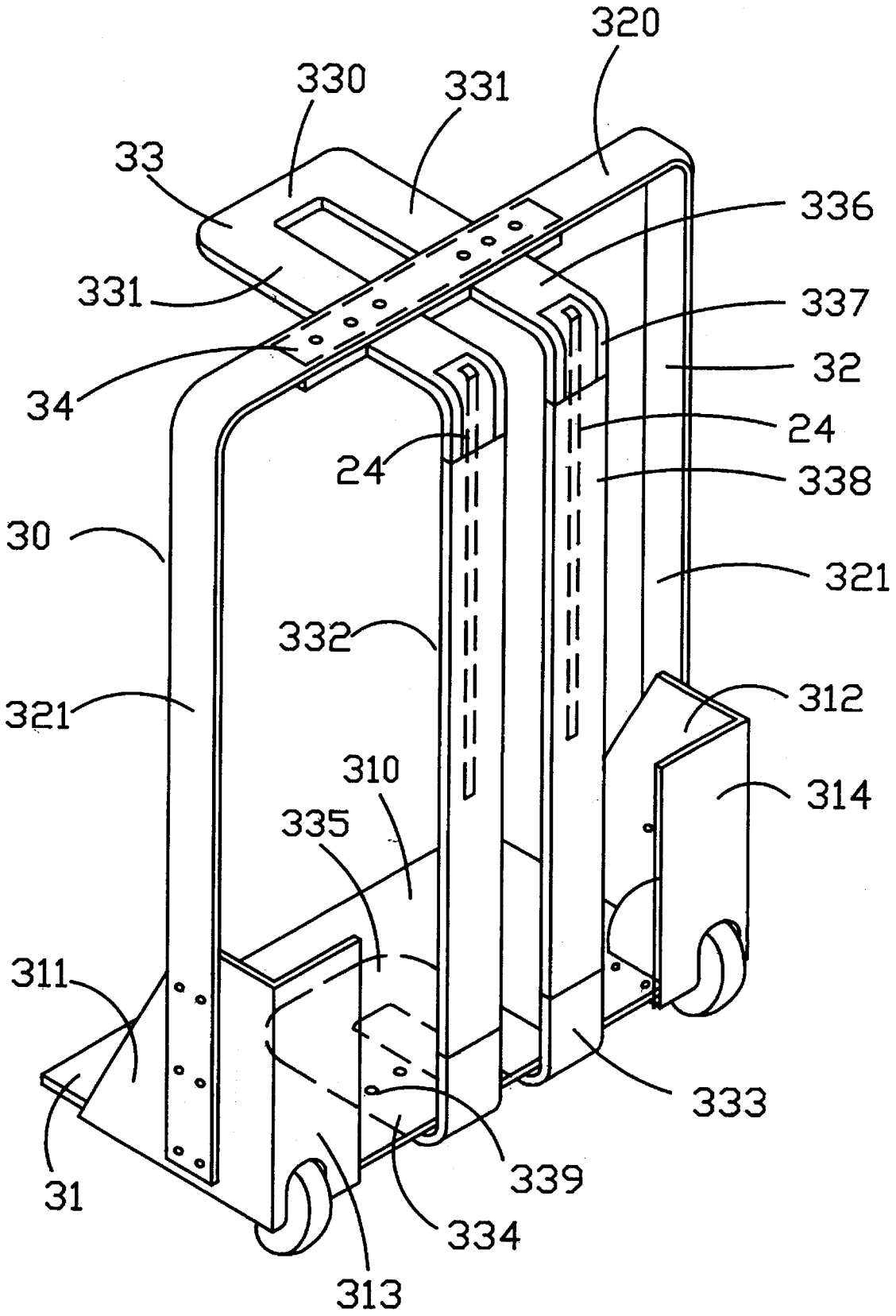
FIG. 3 is a perspective view of an internal frame of the wheeled suitcase shown in FIG. 2.

FIG. 3 is a perspective view of an internal frame 30 for supporting the wheeled suitcase 20 shown in FIG. 2. The internal frame 30 comprises:

(1) a base 31 having a bottom panel 310, a left panel 312 and a right panel 311, the lower cuds of the left and right panels 312 and 311 vertically connected to the left and right ends of the bottom panel 310 separately;

(2) a U-shaped frame 32 mounted on top of the base 31 comprising a top panel 320 and two side panels 321, the upper ends of the two side panels 321 vertically connected to the left and right ends of the top panel 320, the lower cuds of the two side panels 321 mounted to the left and right panels 312 and 311 of the base 31 separately; and (3) a central frame 33 comprising:

(a) a horizontal U-shaped member 330 having two legs 331 on its rear end, and (b) two vertical elongated supporting members 332, the top ends of the two supporting members 332 fixedly connected to the rear ends of the two legs 331 of the U-shaped member 330; wherein the U-shaped member 330 of the central frame 33 is mounted to the approximately central part of the top panel 320 of the U-shaped frame 32 and the lower ends of the two supporting members 332 are mounted to the bottom panel 310 of the base 31 whereby the structure of the internal frame 30 is greatly strengthened by the central frame 33.

The two leg engaging means 24 installed in the central frame 33 are used for engaging the two legs 23 of the pull handle 22 shown in FIG. 2. The central frame 33 is the major supporting structure for supporting the stuffs loaded inside the wheeled suitcase when it is tilted and pulled toward the rearward direction. By integrating the two leg engaging means 24 within the central frame 33 the luggage 20 can reliably be maneuvered by using the pull handle 22 shown in FIG. 2.

Figure 5:
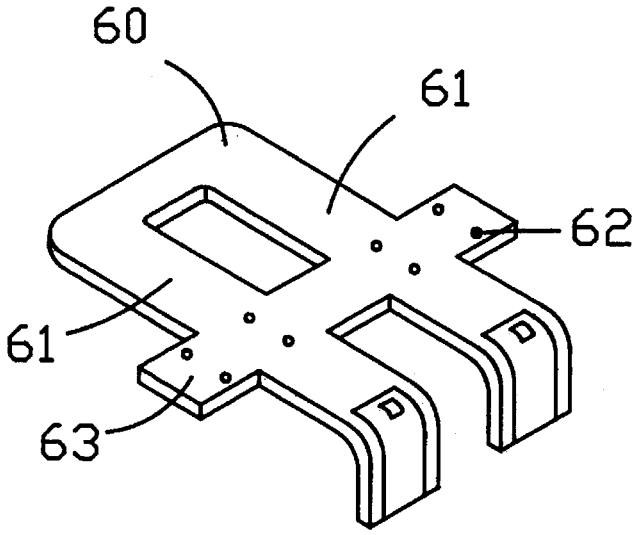
FIG. 5 is a perspective view of another U-shaped member of the central frame according to the present invention.

Both the U-shaped frame 32 and the central frame 33 can be made by using conventional suitcase frame material such as ABS (acrylonitrile butadiene styrene) and PVC (polyvinyl chloride) which are strong and also lightweight. In order to increase the structural strength of the central frame 33 and also the connection force between the top panel 320 of the U-shaped frame 32 and the U-shaped member 330' of the central frame 33, a rigid supporting plate 34 is mounted between the top panel 320 and the U-shaped member 330. Such reinforced connection design provides greater structural strength to the top end of the internal frame 30. Pressures or pulling forces exerted over the top end of the internal frame 30 will be evenly shared between the two side panels 321 of the U-shaped frame 32 and the two supporting members 332 of the central frame 33. If a carrying strap is needed for carrying the suitcase 20, it can easily be installed on top of the rigid supporting plate 34 without causing any structural problem. When pulling the suitcase 20 by using the pull handle 22 shown in FIG. 2, the reinforced connection design will make the structure of the internal frame 30 more reliable in handling the twisting forces. Besides, when the front end of the U-shaped member 330 is used for loading a piggyback suitcase the reinforced connection design can also help to make the connection between the U-shaped member 330 and the top panel 320 more reliable. Another U-shaped member design is shown in FIG. 5 which provides an integral cross bar for strengthening the structure of the U-shaped member just like the rigid supporting plate 34. This new design will be explained later on in FIGS. 5 and 6.

The U-shaped member 330 of the central frame 33 is mounted under the top panel 320 of the U-shaped frame 32 and the two legs 331 of the U-shaped member 330 are mounted to the top panel 320 horizontally. The U-shaped member 330 can also be mounted on top of the top panel 320 of the U-shaped frame 32. In this case a recess should be made over the top panel for taking the U-shaped member 320 above it so that the U-shaped member will not form a protruding part over the top end of the suitcases and thus make it more cosmetically acceptable.

Each of the two supporting members 332 comprises a supporting column 338 on its upper end and a L-shaped integral angle 333 on its lower end. The rear end of each of the two legs 331 of the U-shaped member 330 comprises an integral L-shaped angle 336 having a lower end 337 facing in a downward direction. The upper ends of the two supporting columns 338 are connected to the lower ends 337 of tIM U-shaped member 330 and the lower ends of the two supporting columns 338 are connected to the upper ends of the two L-shaped integral angles 333. Such modular design makes it possible to adjust the height of the central frame 33 by adjusting the length of the two supporting columns 338.

The connecting parts over the upper and lower ends of the supporting columns 338 are intentionally moved away from the angle parts of the central frame 33 so that the four angles 336 and 333 can be made as integral angles. Such integral angle design makes the central frame 33 more reliable in undertaking pressures from the top and bottom ends of the suitcase 20.

The U-shaped member 330 of the central frame 33 is mounted under the top panel 320 of the U-shaped frame 32 and the two legs 331 of the U-shaped member 330 is mounted to the top panel 320 horizontally. The U-shaped member 330 can also be mounted above the top panel 320 of the U-shaped frame 32. In this case a recess should be made on the upper side of the top panel 320 for taking the U-shaped member 330 above it so that the U-shaped member 330 will not form a protruding part over the top end of the suitcase and thus make it more cosmetically acceptable.

The U-shaped member 330 can also be latched to the top panel 320 by using a simple latching means if it is installed above the top panel 320. In this manner the connection between U-shaped member 330 and the top panel 320 can further be simplified without affecting the structural strength of the top end of the internal frame 30.

The lower end of each of the L-shaped integral angle 333 comprises a bottom part 334 facing the front end of the internal frame 30 and the bottom part 334 of the L-shaped integral angle 333 is transversely mounted to the lower end of the bottom panel 310 by using screws 339 in order to support the bottom panel 310 when the wheeled suitcase 20 is tilted and pulled toward the rearward direction. The front ends of the bottom parts 334 of the two L-shaped integral angles 333 are integrally connected together by a horizontal member 335, just like the U-shaped member 330, to strengthen the structure of the lower end of the central frame 33.

The base 31 further comprises two vertical rear panels 313 and 314 for strengthening the structure of the base 31. The rear panel 313 is vertically connected to the rear ends of the right panel 311 and the bottom panel 310, and the rear panel 314 is vertically connected to the rear ends of the left panel 312 and the bottom panel 310.

Figure 4:
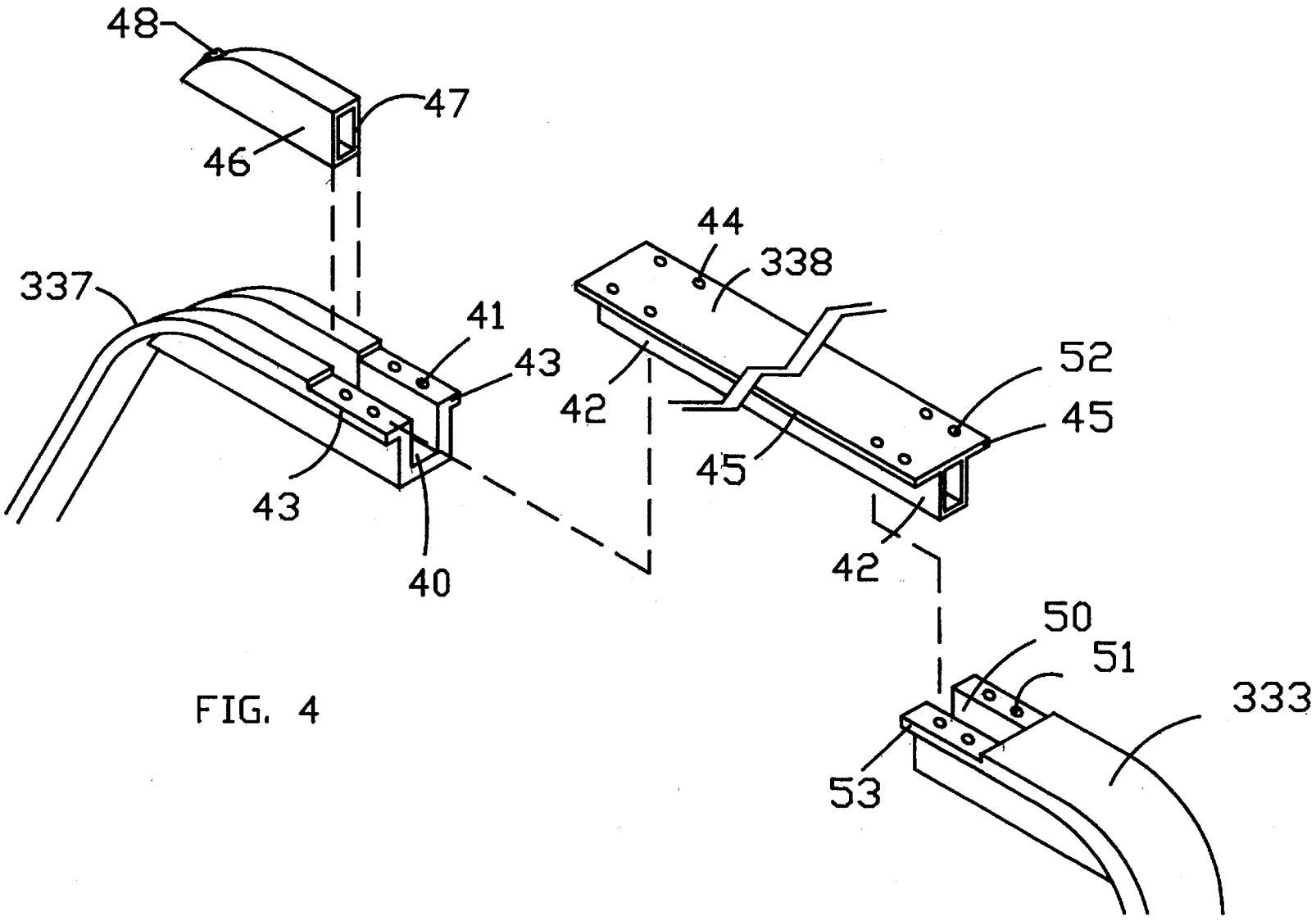
FIG. 4 is an exploded view of part of the central frame according to the present invention.

FIG. 4 is an exploded view of part of the central frame 33 according to the present invention. It shows one lower end 337 of the U-shaped member 330, a head kit 46 of one leg engaging means 24 for engaging one leg 23 of the pull handle 22 shown in FIG. 2, one supporting column 338 and one L-shaped integral angle 333.

The lower end 337 comprises a U-shaped groove 40 and four screw mounting holes 41 over two outer edges 43 for receiving the head kit 46 and the upper end of the supporting column 338. The head kit 46 comprises a rectangular tube 47 and an upper opening 48 for engaging one leg 23 of the pull handle 22. The head kit 46 is vertically mounted to the groove 40 and then fastened together by using four screws (not shown) over its bottom end.

The upper end of the supporting column 338 comprises a rectangular tube 42 for taking one leg 23 of the pull handle 22, and four screw mounting holes 44 over two outer edges 45 for mounting the lower end 337. The rectangular tube 42 of the supporting column 338 is vertically mounted to the groove 40 of the lower end 337 and then fastened together by using :four screws (not shown) through the screw mounting holes 41 and 44.

The lower end of the supporting column 338 comprises four screw mounting holes 52 over two outer edges 45 for receiving the integral angle 333. The integral angle 333 comprises a U-shaped groove 50 and four screw mounting holes 51 over two outer edges 53 for engaging the lower end of the supporting column 338. The rectangular tube 42 of the supporting column 338 is vertically mounted to the groove 50 of the integral angle 333 and then fastened together by using four screws (not shown) through the screw mounting holes 52 and 51. The rectangular structures of the central frame 33 such as the rectangular tube 42 of the supporting column 338 and the two U-shaped groove 40 and 50 greatly strengthen the structure of the central frame so that it can undertake big pressure from stuff loaded in the suitcase 20 when it is tilted.

Figure 6:
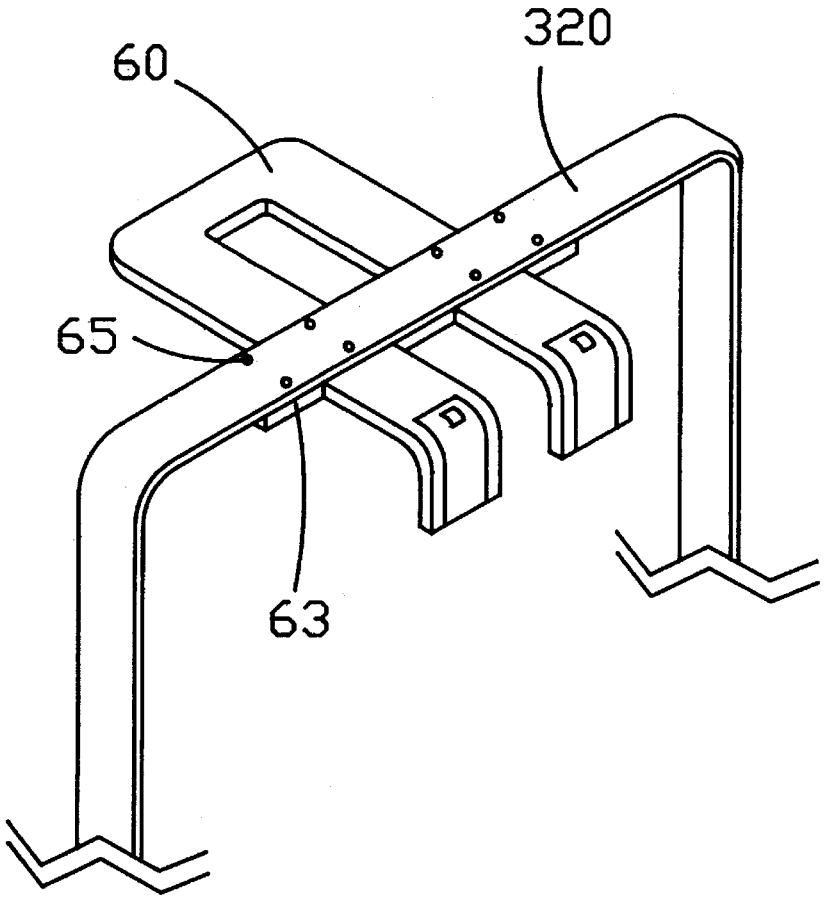
FIG. 6 is a perspective view of the U-shaped member shown in FIG. 5 connected to the top panel of the U-shaped frame.

Please refer to FIGS. 5 and 6. FIG. 5 is a perspective view of a different U-shaped member 60 of the central frame 33 according to the present invention and FIG. 6 is a perspective view of the U-shaped member 60 connected to the top panel 320 of the U-shaped frame 32. The U-shaped member 60 comprises a cross bar 63 integrally connected to the two legs 61 of the U-shaped member 60 with screw mounting holes 62. The cross bar 63 is used to replace the rigid supporting plate 34 shown in FIG. 3 for connecting the top panel 320 of the U-shaped frame 32. The cross bar substantially increases the structural strength of the U-shaped member 60 and also the connection area between the legs 61 of the U-shaped member 60 and the top panel 320 of the U-shaped frame 32. FIG. 6 shows that the cross bar 63 of the U-shaped member 60 is mounted to the approximately central part of the top panel 320 of the U-shaped frame 32 by using screws 65.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A substantially rectangular internal frame for supporting a wheeled suitcase comprising:

(1) a base having a bottom panel, a left panel and a right panel, the lower ends of the left and right panels vertically connected to the left and right ends of the bottom panel separately;

(2) a U-shaped frame mounted on top of the base comprising a top panel and two side panels, the upper ends of the two side panels vertically connected to the left and right ends of the top panel, the lower ends of the two side panels mounted to the left and right panels of the base separately;

(3) a central frame comprising:

(a) a horizontal U-shaped member having two legs, and (b) two vertical elongated supporting members, the top ends of the two supporting members connected to the two legs of the U-shaped member; and (4) a rigid supporting plate; wherein the U-shaped member of the central frame is mounted to the approximately central part of the top panel of the U-shaped frame with the rigid supporting plate mounted in between for strengthening the structure of the central frame and also the connection between the U-shaped member and the top panel and each of the lower ends of the two vertical elongated supporting members of the central frame is mounted to the bottom panel of the base whereby the structure of the internal frame is greatly strengthened by the central frame.

2. The internal frame of claim 1 wherein the end of each of the two legs of the U-shaped member comprises an integral L-shaped angle having a lower end facing a downward direction wherein the top ends of the two supporting members are connected to the lower ends of the two legs of the U-shaped member.

3. The internal frame of claim 1 wherein the U-shaped member is mounted under the top panel of the U-shaped frame.

4. The internal frame of claim I further comprising a pull handle having two legs on its lower end and the central frame further comprising two leg engaging means for engaging the two legs of the pull handle separately wherein the two legs of the pull handle retractably engage the two leg engaging means of the central frame.

5. The internal frame of claim 1 wherein the U-shaped member of the central frame is mounted to the top panel of the U-shaped frame by mounting the two legs of the U-shaped member to the top panel horizontally.

6. The internal frame of claim 1 wherein the lower end of each of the two supporting members comprises an L-shaped integral angle having a bottom part facing the front end of the internal frame and the bottom part of the L-shaped integral angle is transversely mounted to the lower end of the bottom panel in order to support the bottom panel when the wheeled suitcase is tilted and pulled toward the rearward direction.

7. The internal frame of claim 6 wherein the bottom parts of the two L-shaped integral angles are integrally connected together by a horizontal member to strengthen the structure of the lower end of the central frame.

8. The internal frame of claim 1 wherein the base further comprises at least one vertical rear panel wherein the vertical rear panel is vertically connected to the rear ends of one of the left and right panels and the bottom panel to strengthen the structure of the base.

9. A substantially rectangular internal frame for supporting a wheeled suitcase comprising:

(1) a base having a bottom panel, a left panel and a right panel, the lower ends of the left and right panels vertically connected to the left and right ends of the bottom panel separately;

(2) a U-shaped frame mounted on top of the base comprising a top panel and two side panels, the upper ends of the two side panels vertically connected to the left and right ends of the top panel, the lower ends of the two side panels mounted to the left and right panels of the base separately; and (3) a central frame comprising two vertical elongated supporting members, the lower end of each of the two supporting members comprising an L-shaped integral angle having a bottom part wherein the bottom parts of the two L-shaped integral angles are integrally connected together by a horizontal member to strengthen the structure of the lower end of the central frame;

wherein the upper end of each of the two supporting members of the central frame is mounted to the top panel of the U-shaped frame and the bottom parts of the L-shaped integral angles of the two supporting members are transversely mounted to the lower end of the bottom panel in order to support the bottom panel whereby the structure of the internal frame is greatly strengthened by the central frame.

10. The internal frame of claim 9 wherein the central frame comprises a horizontal U-shaped member on its upper end having two legs wherein the top ends or the two supporting members are connected to the two legs of the U-shaped member.

11. The internal frame of claim 10 wherein the end of each of the two legs of the U-shaped member comprises an integral L-shaped angle having a lower end facing downward direction wherein the top ends of the two supporting members are connected to the lower ends of the two legs of the U-shaped member.

12. The internal frame of claim 10 wherein the U-shaped member is mounted under the top panel of the U-shaped frame.

13. The internal frame of claim 9 further comprising a pull handle having two legs on its lower end and the central frame further comprising two leg engaging means for engaging the two legs of the pull handle separately wherein the two legs of the pull handle retractably engage the two leg engaging means of the central frame.

14. The internal frame of claim 10 further comprises a rigid supporting plate mounted between the U-shaped member of the central frame and the top panel of the U-shaped frame to strengthen the structure of the central frame and also the connection between the U-shaped member and the top panel.

15. The internal frame of claim 10 wherein the U-shaped member of the central frame further comprises a cross bar intergrally connected to the two legs of the U-shaped member for connecting the top panel of the U-shaped frame wherein the cross bar of the U-shaped member is mounted to the approximately central part of the top panel of the U-shaped frame.

16. The internal frame of claim 10 wherein the U-shaped member of the central frame is mounted to the top panel of the U-shaped frame by mounting the two legs of the U-shaped member to the top panel horizontally.

17. The internal frame of claim 9 wherein the base further comprises at least one vertical rear panel wherein the vertical rear panel is vertically connected to the rear ends of one of the left and right panels and the bottom panel to strengthen the structure of the base.

18. A substantially rectangular internal frame for supporting a wheeled suitcase comprising:

(1) a base having a bottom panel, a left panel and a right panel, the lower ends of the left and right panels vertically connected to the left and right ends of the bottom panel separately;

(2) a U-shaped frame mounted on top of the base comprising a top panel and two side panels, the upper ends of the two side panels vertically connected to the left and right ends of the top panel, the lower ends of the two side panels mounted to the left and right panels of the base separately; and (3) a central frame comprising:

(a) a horizontal U-shaped member having two legs and a cross bar integrally connected to the two legs of the U-shaped member for connecting the top panel of the U-shaped frame, and (b) two vertical elongated supporting members, the top ends of the two supporting members connected to the two legs of the U-shaped member;

wherein the cross bar of the U-shaped member of the central frame is mounted to the approximately central part of the top panel of the U-shaped frame and the lower end of each of the two supporting members of the central frame is mounted to the bottom panel of the base whereby the structure of the internal frame is greatly strengthened by the central frame.

* * * * *